United States Patent [19]

Chen

[11] Patent Number: 5,058,898

[45] Date of Patent: Oct. 22, 1991

[54] BALL GAME DEVICE

[76] Inventor: Pan B. S. Chen, P.O. Box 15316, Arlington, Va. 22215

[21] Appl. No.: 632,453

[22] Filed: Dec. 27, 1990

[51] Int. Cl.[5] ..... A63B 67/00

[52] U.S. Cl. ..... 273/401; 273/412; 273/DIG. 19

[58] Field of Search ..... 273/401, 412, 414, DIG. 19, 273/DIG. 17, DIG. 18

[56] References Cited

U.S. PATENT DOCUMENTS

| | | | |
|---|---|---|---|
| 3,774,910 | 11/1973 | Walker, Jr. | 273/414 |
| 3,806,123 | 4/1974 | Fennell | 273/DIG. 14 X |
| 3,836,143 | 9/1974 | Trent et al. | 273/DIG. 19 X |
| 3,913,916 | 10/1975 | Martin, Jr. | 273/396 |
| 3,936,051 | 2/1976 | Walker, Jr. | 273/414 X |
| 4,088,251 | 5/1978 | Rodriguez | 273/73 R X |
| 4,248,435 | 2/1981 | Barmore | 273/412 |
| 4,274,639 | 6/1981 | Flanders | 273/412 X |
| 4,718,677 | 1/1988 | Barnes | 273/412 |
| 4,971,334 | 11/1990 | Stewart | 273/346 |

*Primary Examiner*—William H. Grieb

[57] ABSTRACT

A ball game device comprising:

(A) a ball storing portion which is hollow, which has at least one opening so that a ball can enter the portion, and which has at least a wall which is normally closed and can be opened so that a ball in the portion can exit;

(B) a ball receiving portion which is hollow, which has at least one opening so that a ball can enter the receiving portion, and which has at least a wall which is normally closed and can be opened so that a ball in the receiving portion can exit; and (C) a fastening portion for removably attaching the ball storing portion and the ball receving portion to a player.

5 Claims, 1 Drawing Sheet

FIG. 1
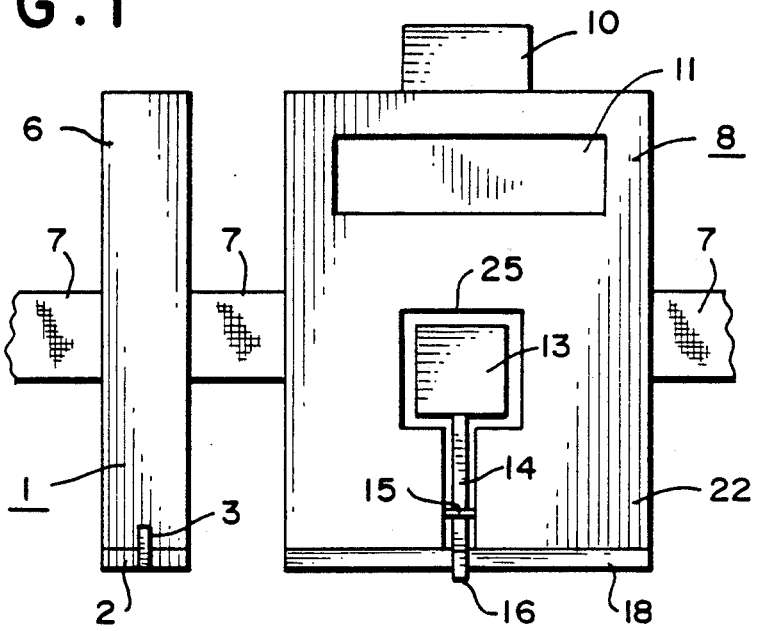
FIG. 2
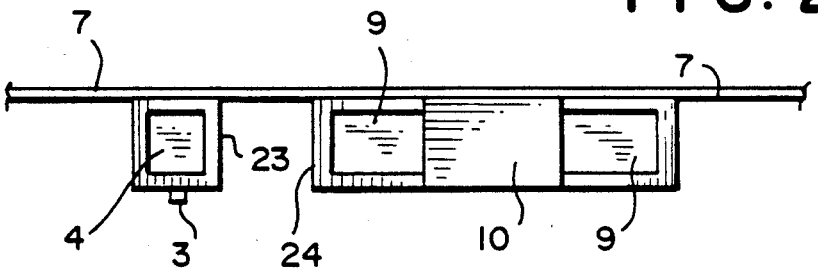
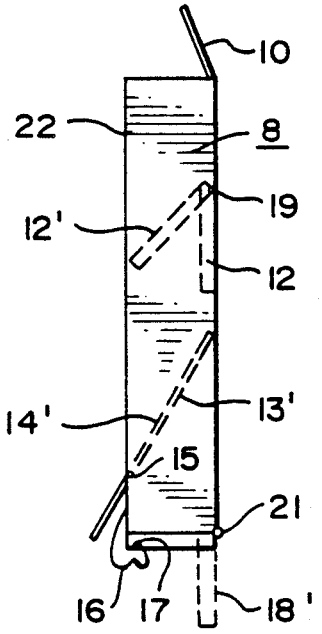
FIG. 3
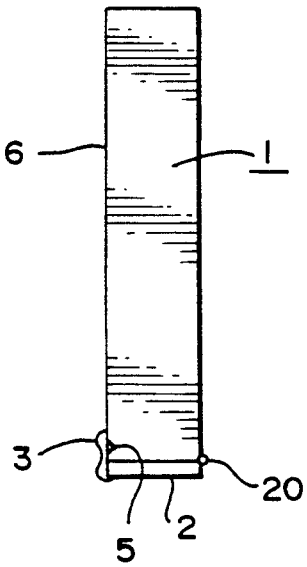
FIG. 4

BALL GAME DEVICE

BACKGROUND OF THE INVENTION

This invention relates to a ball game device, particularly to a device which can be worn on a player who can try to throw a ball to a ball receiving means worn by another player and vice versa. The device can also include a ball storing means which is also worn on a player.

U.S. Pat. Nos. 4,971,334; 4,718,677; 4,274,639; and 3,774,910 disclose various devices involving the throwing of a ball.

It is an object of the present invention to provide a throw game which is more challenging.

SUMMARY OF THE INVENTION

A ball game device comprising:

(A) a ball storing means which is hollow, which has at least one opening so that a ball can enter the means, and which has at least a wall which can be opened so that a ball in the means can exit;

(B) a ball receiving means which is hollow, which has at least one opening so that a ball can enter the means, and which has at least a wall which can be opened so that a ball in the means can exit; and (C) a fastening means for removably attaching the ball storing means and the ball receiving means to a player.

DESCRIPTION OF THE DRAWINGS

FIG. 1 is a perspective view of the ball game device of the present invention;

FIG. 2 is a side perspective view of the ball receiving means;

FIG. 3 is a side perspective view of the ball storing means; and

FIG. 4 is a top view of the ball game device.

DESCRIPTION OF THE PREFERRED EMBODIMENT

FIGS. 1–4 show the preferred embodiment of the present invention which essentially includes a ball storing means 1, a ball receiving means 8, and a belt 7. The belt 7 has a securing means such as VELCRO(hooks and loops) or a buckle (not shown in the drawings) so that the whole ball game device can be worn on a player's body (e.g., at chest or waist).

The ball storing means 1 can store balls for the player who is wearing the ball storing means 1. The ball storing means 1 is hollow and is provided with an opening 4 on the top, and a bottom wall 2 hingedly fastened to it with a hinge 20. A securing means 3 can be semi-rigid and is fixed to the front side of the bottom wall 2 and can snap fit to a recess 5 formed on a front wall 6 of the ball storing means 1 so that the bottom wall 2 can be kept at a closed state.

The ball receiving means 8 can receive balls thrown by the other players. The ball receiving means 8 is hollow and has an opening 9 on the top, and an opening 11 and an opening 25 on the front wall 22 thereof. A deflecting plate 10 is provided on the top portion of the ball receiving means 8 so that a ball thrown from the front side of the device to the deflecting plate 10 can easily enter the ball receiving means 8. A pivot rod 15 is fixed on the front wall 22 at the lower portion of the opening 25. A support 14 is pivotably fastened to the rod 15. A door 13 is fixed on the top end of the support 14. A securing means 16 is fixed to the lower end of the support 14 and can snap fit to a recess 17 formed on a bottom wall 18 of the ball receiving means 8. The bottom wall 18 is hingedly fastened to the ball receiving means 8 with a hinge 21. A plate 12 is hingedly fastened to the inner space of the ball receiving means 8 with a hinge 19 so that when the player wearing the device falls to the ground, the ball can be prevented from exiting the ball receiving means 8 because the plate 12 will assume position shown at 12'.

Various variations can be made to the preferred embodiment shown hereinabove. For example, an extra ball storing means can be provided on the left hand side of the ball receiving means 8; the securing means 3 and 16 can be of other structures such as snap fasteners, VELCROS (hooks and loops, with hooks or loops on the front wall 6 or the bottom wall 18, loops or hooks fixed on the securing means 3 and 16), or the like; the ball storing means 1 and the ball receiving means 8 can be formed together (i.e., a side wall 23 and a side wall 24 can be of the same one wall); there can be more than one belt 7; and the opening 4 on the top of the ball storing means 1 can be of a funnel shape so that the player can bring a ball from the ball storing means 1.

The walls of the device of the present invention can be made of a flexible material or a rigid material. A soft covering can be provided on the outer surface if it is made of a rigid material. Appropriate frame material can be provided to maintain the shape thereof if it is made of a flexible material. Furthermore, the device can be of an inflatable structure, i.e., the walls can be made of sheets fastened together to form a hollow space between each two sheets (two sheets form a wall) so that when the device is not in use, it can be in a deflated and folded position to save space; when the device is to be used, it can be inflated and the players can be prevented from being hurt by the device since the device is soft. In this example; the door 13, and the plates 10 and 12 can also be made of a rigid material, or an inflatable material with the sheets welded to the support 14, or the ball receiving means 8, respectively.

The balls used for this invention can be made of soft material (e.g., foam material or the like). In order to be of some weight, the balls can be of weighted type (i.e., a rigid weight or core embedded in the ball). The walls of the device can be made of transparent material. Indicating means (e.g., light bulb in combination with a photodetector means) can be provided to indicate that a ball or balls is in the ball storing means 1 or the ball receiving means 8 if the device is not made of transparent material.

The player can wear the device of this invention, with some balls on the field (ground) or in the ball storing means 1. Each player can try to throw a ball into the ball receiving means 8 worn by a player of the opponent team through the opening 9 or 11. At the end of the game (each game may be of a period of time, e.g., 10 minutes), the balls in the ball receiving means 8 worn on each player are counted. The winner team is the team having less total amount of such balls. During the game, a player can try to "deplete" the ball storing means 1 worn by the player of the opponent team by opening the bottom wall 2 so that the balls stored therein can fall down to the ground and the players can try to pick up the balls and put the same into the ball storing means 1 of their own or the ball receiving means 8 of the opponent player, or simply kick the balls to a location of their choice. Also, during the game, a player can try to "relieve" the balls in the ball receiving means 8 worn by another player of the same team by throwing a ball at the door 13 so that the support 14 can be at the position shown at 14 and the bottom wall 18 can be opened (as shown at 18'). Of course, the minimum distance between the two players when one player is trying to throw a ball at the door 13 can be stipulated in the rules. For example, a football field can be used for this game, and the two players must be at least one "section" apart each other.

Some protection means can be provided to protect the facial and genitals portion of the players if a ball of significant weight is to be used or if there is a possibility of injury.

I claim:

1. A ball game device comprising:

(A) a ball storing means which is hollow, which has at least one opening so that a ball can enter the means, and which has at least a wall which is normally closed and can be opened so that a ball in the means can exit;

(B) a ball receiving means which is hollow, which has at least one opening so that a ball can enter the means, and which has at least a wall which is normally closed and can be opened so that a ball in the means can exit; and (C) a fastening means for removably attaching the ball storing means and the ball receiving means to a player.

2. A ball game device as defined in claim 1 in which the ball receiving means is further provided with a plate hingedly fixed to the inner wall of the ball receiving means to prevent a ball from exiting the means when the means is tilted.

3. A ball game device as defined in claim 1 in which the ball receiving means is further provided with a normally closed door which can be opened when a sufficient force is imposed on the door.

4. A ball game device as defined in claim 1 in which the opening of the ball storing means is of funnel shape.

5. A ball game device comprising:

(A) a ball receiving means which is hollow, which has at least one opening so that a ball can enter the means, and which has at least a wall which is normally closed and can be opened so that a ball in the means can exit; and (B) a fastening means for removably attaching the ball receiving means to a player.

* * * * *